United States Patent [19]

Hoyt et al.

[11] Patent Number: 4,707,964

[45] Date of Patent: Nov. 24, 1987

[54] METHOD OF PROVIDING SUPPORT FOR AN ELONGATED TOWER LEG

[75] Inventors: Robert M. Hoyt; Edward Dziedzic; William M. Rinehart, all of Centralia, Mo.

[73] Assignee: A. B. Chance Company, Centralia, Mo.

[21] Appl. No.: 789,104

[22] Filed: Oct. 18, 1985

Related U.S. Application Data

[62] Division of Ser. No. 489,861, Apr. 29, 1983, Pat. No. 4,561,231.

[51] Int. Cl.[4] ..... E02D 27/00

[52] U.S. Cl. ..... 52/742; 52/297; 52/309.17; 52/157; 52/165

[58] Field of Search ..... 52/743, 742, 741, 297, 52/298, 704, 707, 309.3, 309.17, 157, 165, 166

[56] References Cited

U.S. PATENT DOCUMENTS

| | | | |
|---|---|---|---|
| 12,385 | 8/1905 | Bruley | 52/298 X |
| 1,630,804 | 5/1927 | Scholes | 52/166 |
| 3,403,520 | 10/1968 | Goodman | 52/298 X |
| 4,339,899 | 7/1982 | Klenk et al. | 52/157 |

FOREIGN PATENT DOCUMENTS

| | | | |
|---|---|---|---|
| 1383253 | 11/1964 | France | 52/157 |

*Primary Examiner*—Carl D. Friedman

*Attorney, Agent, or Firm*—Schmidt, Johnson, Hovey & Williams

[57] ABSTRACT

An improved tower foundation is provided which is inexpensive to manufacture and when installed, serves to securely support a leg of power transmission towers and the like. The tower foundation hereof includes a screw-type earth anchor member having a tubular cavity at the uppermost end thereof. An elongated tower leg connector member is positioned and secured in the cavity of the installed anchor by an initially flowable, solidified material (preferably a sand/epoxy resin mixture). The tower leg connector member advantageously comprises a lowermost, tubular first portion and an uppermost, L-shaped in cross-section second, apertured connection portion, with the first and second portions having approximately coincidental centroidal axes. Preferably, the tower leg connector member is positioned in the cavity prior to setting of the solidifiable material, and can be adjusted as necessary for proper alignment and securement thereof to the tower leg, thereby compensating for slight anchor member installation error.

3 Claims, 16 Drawing Figures

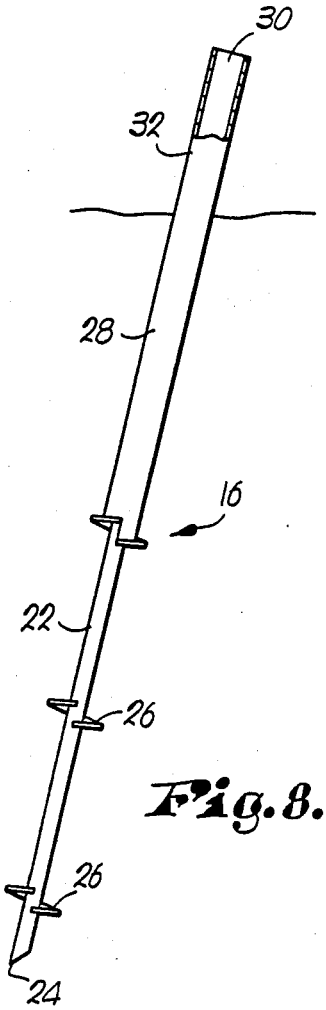
Fig. 8.
Fig. 9.
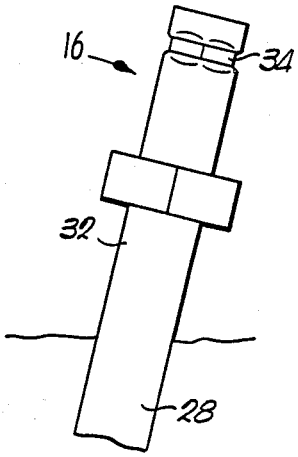
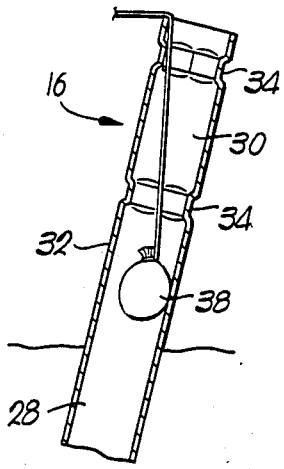
Fig. 10.
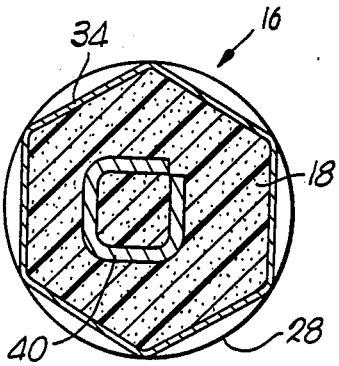
Fig. 7.
Fig. 11.
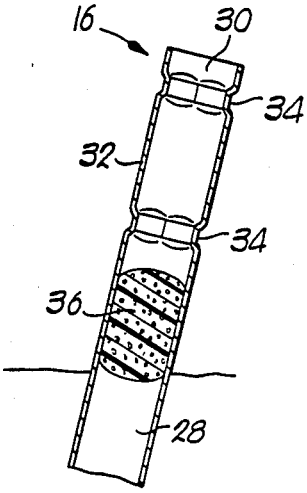
Fig. 12.
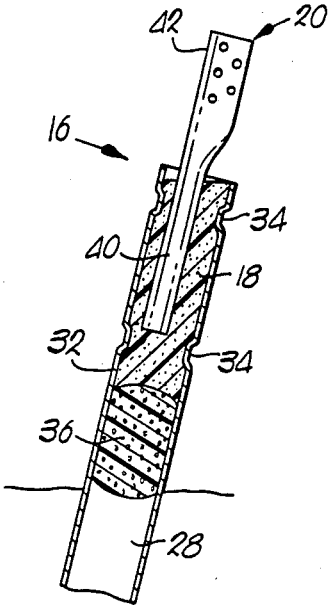

Fig. 13.
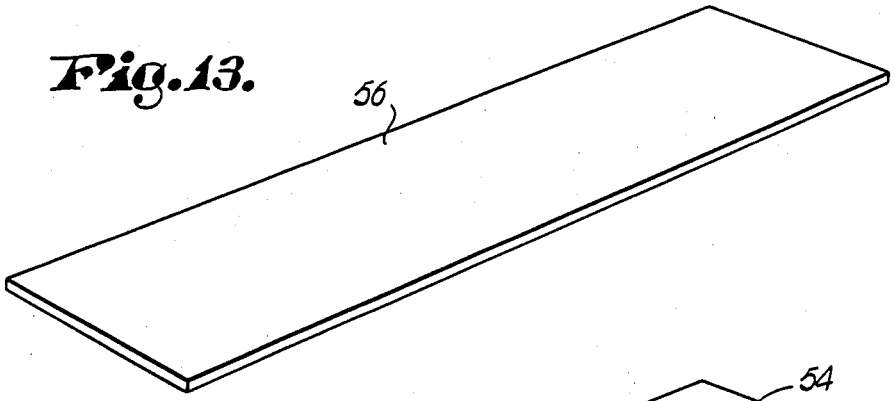
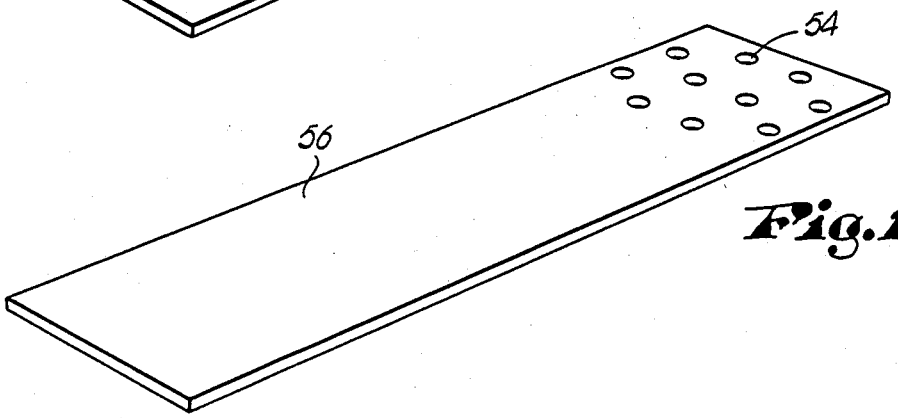
Fig. 14.
Fig. 15.
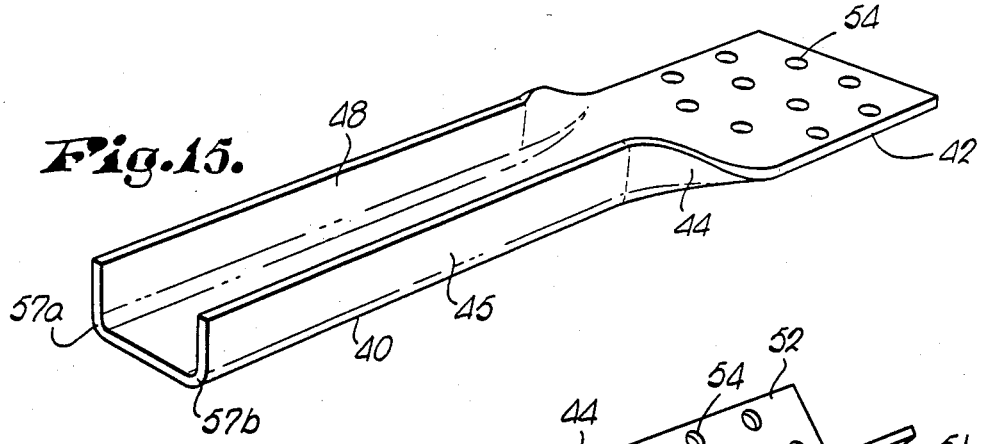
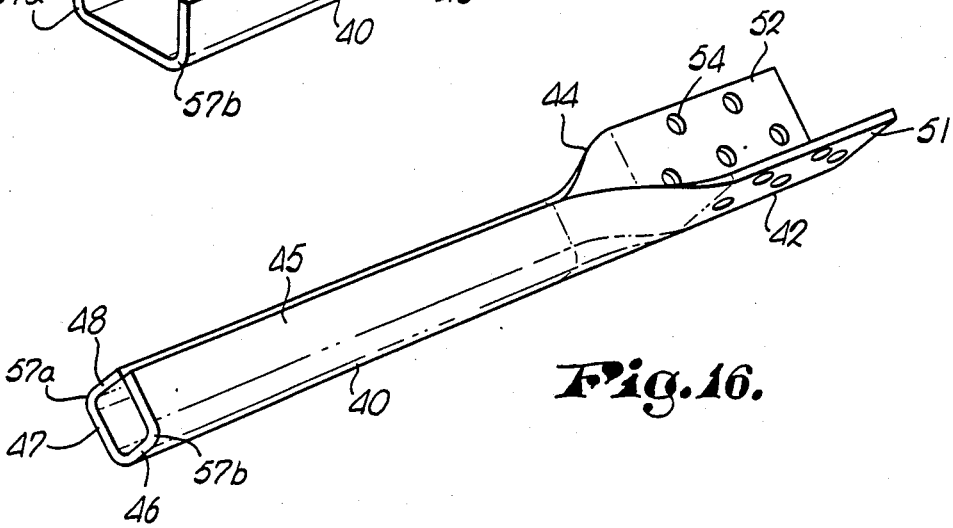
Fig. 16.

METHOD OF PROVIDING SUPPORT FOR AN ELONGATED TOWER LEG

This is a division of application Ser. No. 489,861 filed on Apr. 29, 1983, now U.S. Pat. No. 4,561,231, 12-31-85.

BACKGROUND OF THE INVENTION

1. Field of the Invention

This invention relates to a foundation (and a corresponding method of foundation installation) for anchoring and supporting a tower, such as transmission line towers and the like, with the foundation hereof being easily and inexpensively installed to provide a high-strength foundation for such a tower. More particularly, it is concerned with a screw anchor foundation which can accommodate slight anchor installation errors by provision of a connector-receiving cavity adjacent the upper end of the anchor which receives an initially flowable, solidifiable fill material (such as synthetic resin) along with an elongated tower leg connector; the latter can be accurately positioned relative to the tower leg to present, upon setting of the fill material, a properly aligned, rigid tower leg connection.

2. Description of the Prior Art

As those skilled in the art will appreciate, large upright power transmission line towers can present difficult problems from the standpoint of providing proper foundation support. Specifically, a great deal of weight must be supported, the tower must be positioned to avoid undue bending or torsional loads, and the tower foundation must be able to withstand extreme, wind-induced loads imposed on the tower. Heretofore, the most prevalent method of anchoring free standing transmission line towers has been the use of concrete pads poured in place at the four corners of the tower for supporting the tower legs. As can be appreciated, the concrete pads must be sufficiently embedded in the earth and reinforced to withstand the tension, compression and wind loading imposed on the overall structure. Typically, in such an installation an adjustable leg anchor is embedded in the concrete prior to setup, so that upon hardening of the cement, the leg anchors can be used to connect the respective tower legs to the concrete pad.

Although the use of properly constructed concrete pads to anchor transmission line towers is a practice of long standing, many problems are presented with such an anchoring method. For example, the size and strength of the concrete pad required for the particular application will vary according to the tower size, soil conditions, conductor stringing loads and anticipated wind loads. Additionally, constructing such concrete pads requires hauling to the job site excavation equipment, concrete forms, and often a large amount of concrete, all of which can be difficult in remote regions far from adequate access roads. Further, in some locations, such as swampy ground, it is difficult and very expensive to construct proper concrete pads.

These difficulties have led to suggestions of using conventional screw anchors as foundations for transmission line towers. Screw anchors have the advantages of easy installation, relatively easy transportation to the job site, and adaptability for use in many types of soil conditions, including swampy ground. However, the straightforward approach of simply installing four screw anchors into the earth and simply attaching tower legs thereto has proven to be impractical. This stems from the inherent difficulty of driving an anchor into the ground with the required precision that the upper extremity of such anchor is exactly aligned with a respective tower leg for direct bolting of the latter to the anchor shaft or tube. Not only is it impractical to install the screw anchor at an exact required angle with respect to the vertical because of the inability to start such anchor with required accuracy, but equally as important, differences in the stratum of the ground as the anchor is driven into the latter causes deflections of the anchor to one side or the other depending upon the nature of the soil. As a result the upper end of the anchor after completion of the installation therof is not necessarily in the precise position required for alignment with a respective tower leg.

It has been suggested in this regard that perhaps the screw anchor foundations can be welded to the tower legs and if necessary intermediate metal shims or connectors may be welded between the screw anchor foundation and the corresponding tower legs to compensate for misalignment of the anchor with the tower leg extension. Although field welding might in many instances solve the problem presented, it is not a satisfactory solution from a construction standpoint because of the difficulty of controlling the quality of the welds under field conditions, the need to transport the necessary welding apparatus to the construction site, the absolute requisite of employing highly skilled welders who can perform quality welding under extremely adverse field conditions, and the reluctance of utilities to support very high volatage electrical conductors on towers where the integrity of the system is dependent on the quality of the welding which has not and cannot be subjected to the same analytical techniques available in shop welding fabrication.

A recent breakthrough in the art is described in U.S. Pat. No. 4,339,889. This patent describes an adjustable connector for tower legs which overcomes the problems outlined above and greatly facilitates use of screw anchors as foundations for upright towers. This device avoids the need for field welding, but is still relatively expensive and requires considerable effort to install.

SUMMARY OF THE INVENTION

The tower foundation includes an essentially conventional screw anchor, thereby circumventing many of the transportation and construction problems associated with using poured concrete pads. Additionally, the device hereof is relatively inexpensive, can easily and quickly be installed without undue manufacturing or installation delays, and can accommodate normal errors in anchor installation.

The tower foundation hereof broadly includes an anchor member including an elongated shaft, an outwardly extending, load-bearing element (e.g. one or more helical blades) affixed to the shaft, with the anchor member having a tubular cavity at the upper end thereof. An elongated, upright metallic tower leg support structure is positioned in the anchor member cavity and presents a lowermost, tubular portion and an uppermost portion having structure for connection to the tower leg. An initially flowable, solidifiable fill material is placed in the anchor cavity for enveloping and supporting the lower tubular portion of the support structure; upon setting of the fill, the support structure is rigidly secured in place. Preferably, the uppermost portion of the tower leg support structure is L-shaped in cross-section and the lowermost and uppermost portions have approximately coincident centroidal axes.

The method of installation of the tower foundation in accordance with the present invention involves first installing a screw anchor into the earth at a preselected location and angle for supporting the tower leg, and filling the hollow cavity at the upper end of the screw anchor with the initially flowable fill material which will thereafter harden and set. Before hardening, the tower leg connector member is placed in the material-filled cavity and positioned as necessary to properly align the member for later securement to the tower leg, thereby compensating for any minor installation error of the screw anchor. Advantageously, the member is maintained in proper alignment until the hardening material has set, whereupon the member is connected to the tower leg. In particularly preferred forms, the initially flowable, hardening material comprises an epoxy resin and sand mixture. As those skilled in the art will appreciate, the lower and upper portions of the tower leg connector member hereof, in addition to having approximately coincident centroidal axes, should also have approximately equal section moduli, thereby providing maximum strength at optimum cost.

BRIEF DESCRIPTION OF THE DRAWING

FIG. 7 is a horizontal sectional view taken along line 7—7 of FIG. 2;

FIGS. 8–12 inclusive are schematic depictions of the normal installation steps of the foundation hereof, wherein:

FIG. 8 is an elevational view of the screw anchor in accordance with the present invention embedded in the earth;

FIG. 9 is an elevational view of the cavity portion of the screw anchor hereof, showing a hexagonal constriction being transversely crimped therein;

FIG. 10 is a vertical sectional view of the cavity portion of the screw anchor hereof illustrating the positioning of plug-forming, expandable material in the cavity;

FIG. 11 is a vertical sectional view similar to FIG. 10, illustrating the plug secured in the cavity; and FIG. 12 is a sectional view depicting the epoxy resin/sand mixture disposed above the cavity plug and hardened to rigidly secure the tower leg connector member in position;

FIGS. 13–16 inclusive are schematic illustrations of the method of forming the tower leg connector member of the present invention, wherein:

FIG. 13 is a perspective view of an elongated, flattened, metallic plate which is the starting component of the tower leg connector member;

FIG. 14 is a perspective view similar to FIG. 13, illustrating the connection bores formed in the upper end of the connector member;

FIG. 15 is a perspective view illustrating the initial bend made in the sheet to form the tower leg connector member; and FIG. 16 is a perspective view illustrating the completed tower leg connector member.

DESCRIPTION OF THE PREFERRED EMBODIMENT

Figure 1:
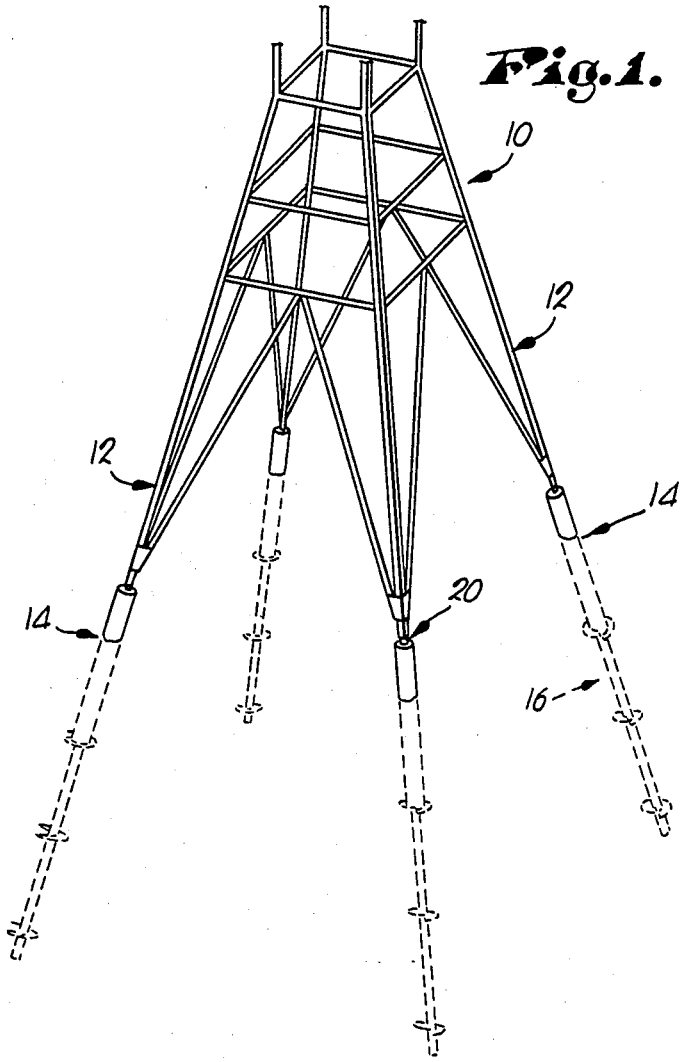
FIG. 1 is a perspective view of the lower portion of a free standing, lattice type transmission line tower shown secured to four tower foundations in accordance with the present invention.

Referring now to the drawing, a free standing, lattice-type transmission line tower 10 having four support legs 12 is illustrated in FIG. 1, with each leg 12 being supported by a tower foundation 14 in accordance with the present invention. Each foundation 14 broadly includes an elongated screw anchor 16, a solid fill material 18 received in the uppermost end of the anchor 16, and an elongated tower leg connector member 20 secured in the upper end of anchor 16 and held securely in place by the material 18.

Figure 2:
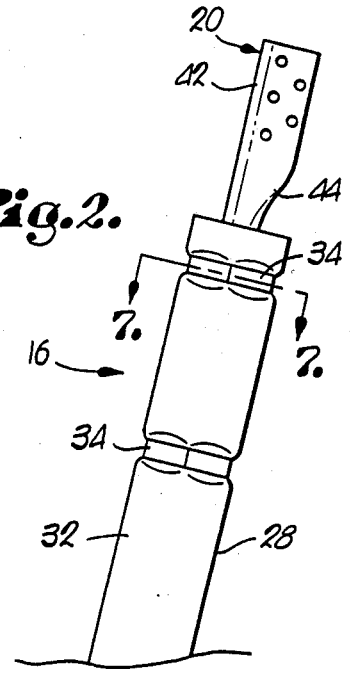
FIG. 2 is an elevational view of the exposed end of a screw anchor in accordance with the invention, with the tower leg connector member secured in place therein.

In more detail, the screw anchor 16 presents a lowermost, elongated shaft 22 having a beveled, earth penetrating lead 24 at one end thereof, and three outwardly extending, axially spaced apart helical blades 26 affixed to the shaft 22. An uppermost, elongated, tube 28 defining an internal cavity 30 therein is affixed to the shaft 22 opposite lead 24. As seen in FIG. 8, when installed in the earth the tube 28 normally has a portion 32 exposed above ground level. As best seen in FIGS. 2, 11, the exposed portion 32 has two axially spaced apart transverse, hexagonal in cross-section constrictions 34 formed therein.

The fill material 18 can be cement, or any cement-like material, with properties such that the material is initially flowable and will harden and rigidly set over time. As is evident in FIG. 8, such a fill material 18 could fill the entire cavity 30 above shaft 22. However, in the preferred embodiment, a plug 36 is disposed in the tubular portion 32 above shaft 22, thereby eliminating the unnecessary cost of filling the entire cavity 30 with material 18. Also, the preferred fill material comprises an epoxy/sand filler mixture (preferably 85% sand and 15% epoxy resin by weight). The particular epoxy resin used as the material 18 must have low viscosity, controllable exothermic properties, reasonable curing time under normal conditions, adequate pot life, and sufficient strength. Although a wide variety of polymerizable resins such as polyesters and urethanes having the above properties could be used, the preferred epoxy resin used includes approximately 53% by weight diglycidyl ether of bisphenol A, 13% by weight butyl glycidyl ether, and 34% by weight polyoxypropylenetriamine.

As illustrated in FIG. 10 an elastic, expandable plastic bag 38 containing the reactants formulating the plug 36 is positioned in the cavity 30 below the lowermost constriction 34. Plug 36 is simply a conventional, catalyst-induced, expanding foam such as a polyurethane foam formulation. In practice, the bag 38 is maintained in position while the foam expands to wedge itself in the cavity 30, thereby forming the plug 36.

Figure 5:
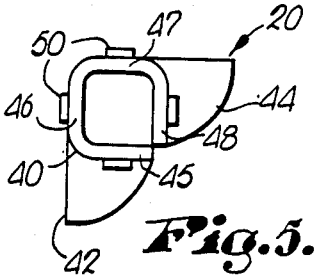
FIG. 5 is a bottom view of the tower leg connector member hereof.
Figure 6:
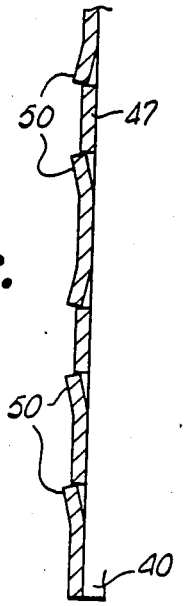
FIG. 6 is a sectional view taken along line 6—6 of FIG. 3 illustrating the protrusions on the tower leg connector member.

The tower leg connector member, as best seen in FIGS. 3–6, includes a lowermost tubular portion 40 an uppermost L-shaped in cross-section portion 42, and a curvilinear transition portion 44 interconnecting the portions 40, 42. Turning to FIG. 5, it is seen that the lower portion 40 presents an approximately square in cross-section body having four sidewalls 45, 46, 47 and 48. Each sidewall 45–48 has a plurality of outwardly-extending protrusions 50 formed therein by punching. In other forms of the invention, however, appropriate protrusions can be formed by any process which presents an outwardly extending surface from the rectilinear sidewalls 45–48. For example, small metal blocks may be welded to the respective sidewalls. However, in the preferred embodiment as shown, the protrusions 50 are outwardly punched sections of each sidewall (see FIG. 6). The protrusions facilitate bonding between the member 20 and the surrounding fill 18.

The upper portion 42 of member 20 (see FIGS. 3–4) comprises two rectangularly-shaped plates 51, 52 transversely interconnected to present an Lshaped cross-section. Additionally, each plate has a plurality of circular bores 54 extending therethrough.

Viewing FIGS. 13–16, the preferred method of fabricating the tower leg connector member 20 is illustrated. As seen in FIG. 13, a rectangularly shaped, flattened malleable blank 56 is used as the starting component for the formation of the member 20. Next, connector bores 54 are drilled in the blank 56 adjacent one end thereof. The first bending operation is performed to form the respective walls 45, 48 as seen in FIG. 15. Thus, the blank 56 is bent for only a portion of the length thereof along two elongated fold lines 57*a* and 57*b* respectively parallel to the lateral side margins of the blank 56, to present a U-shaped in cross-section body. The last bending operation (see FIG. 16) involves bending the body depicted in FIG. 15 along the entire length thereof between the fold lines 57*a* and 57*b* to present the final L-shaped in cross-section upper portion 42 and the tubular portion 40. The finished member 20 must be of sufficient strength (tension, compression, shear, tension, bending) to support the heavy loading imposed thereupon. To meet this requirement, the member 20 is formed with the centroidal axis of the cross section of the lower portion 40 approximately coincident with the centroidal axis of the cross section of the upper portion 42; in addition, the portions 40, 42 have approximately equal section moduli. In practice, the minimum section modulus of either of the portions 40, 42 is greater than that necessary to withstanding the anticipated bending loads from the tower legs 12.

In installation procedures, the erection site for the tower 10 is selected and the approximate location of the tower legs 12 determined. Foundations 14 are then power driven into the earth at the preselected locations and installation angles (see FIGS. 1 and 8). A reference elevation plane is determined so that the tower 10 will be level upon erection, and to this end the individual tubes 28 of the respective anchors 16 are cut (not shown) in such a manner that each tube 28 is disposed an equal distance below the reference plane. Next, as seen in FIG. 9, a hydraulic crimping tool is used to form two hexagonal in cross-section constrictions 34 around the exposed tube portion 32. The constrictions 34 are preferably approximately 15 inches apart and serve to prevent load-induced withdrawal of fill 18 in the completed foundation. The polyurethane formulation is mixed in the plastic bag 38 and positioned in the tubular portion 32 below the lowermost constriction 34 (see FIG. 10). While the bag 38 is held in place, the polyurethane foam expands within the confines of the cavity 30 to form the conforming plug 36 as seen in FIG. 11.

After the plug 36 is secured in the cavity 30, the tower leg connector member 20 is positioned in the cavity 30 in the proper position for later securement to the tower leg 12. While maintaining the position of the member 20 in the cavity 30 (using a positioning fixture or the like), the fill material 18 is poured in the cavity 30. If cement is used as the hardening material 18, it may be mixed and poured in one lift. It has been found that the epoxy resin/sand mixture in accordance with the preferred embodiment is best placed in the cavity 30 by first mixing the two epoxy components, and then mixing them thoroughly into builders sand which has been heated to approximately 160° F. When the sand is completely wetted with epoxy resin, the mixture is poured into cavity 30 until material 18 nearly fills the entire cavity 30 above plug 36 (see FIG. 12). As those skilled in the art will appreciate, as an alternative to the preferred method of placing the epoxy resin/sand mixture into cavity 30, it may be desirable to mix and pour the epoxy resin/sand mixture in two or three lifts. Using several lifts to fill cavity 30 permits the mixing and handling of smaller quantities of epoxy resin and sand, making each lift more wieldable. The proper position of the member 20 within cavity 30 is maintained until the fill material 18 has hardened sufficiently to properly support the member 20. This time may vary from several minutes to several hours depending on the type of material 18 used and climatic conditions.

Figure 3:
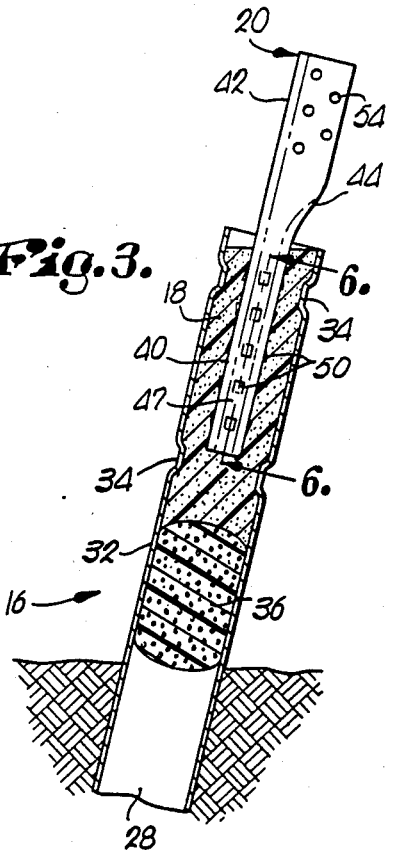
FIG. 3 is a vertical sectional view, similar to FIG. 2, showing in detail the lowermost cavity plug and the epoxy resin/sand fill mixture employed for securing the tower leg connector member in place.
Figure 4:
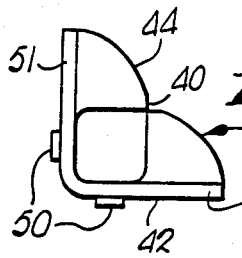
FIG. 4 is a plan view of the tower leg connector member hereof.

As illustrated in FIG. 3, the constrictions 34 secure the material 18 in the cavity 30 after the material 18 has hardened, thus preventing uprooting or withdrawal of the fill and consequent failure of the foundation. Protrusions 50 on the lower portion 40 likewise aid in securing the member 20 within the material 18. In the preferred embodiment, the epoxy/sand mixture has been found to have several advantages over cement grout. For example, the epoxy/sand mixture exhibits better adhesion to the galvanized member 20, higher strengths, and shorter cure time.

As noted, minor errors in anchor installation are the inevitable result of field operations. However, it has been found that the foundation and method of installation hereof can compensate for typical eccentricities and angular misalignments encountered in practice. Thus, the present invention provides an inexpensive readily usable means of employing screw anchors as tower foundations, while overcoming the sometimes vexatious problems inherent in anchor installation.

We claim:

1. A method of providing support for an elongated tower leg, comprising the steps of:

providing an elongated screw anchor having a lower, elongated shaft portion and an outwardly extending, helix-defining, load-bearing element affixed in transverse relationship to the longitudinal axis of said shaft portion;

rotating the shaft portion while said load-bearing element is in contact with the earth to at least partially imbed said screw anchor in an upright position in the ground;

interrupting the rotation of said shaft portion of said anchor to position an upper portion of said anchor having cavity defining structure at any selected one of a number of different elevations relative to the level of the ground;

securing a plug in said anchor cavity at the upper portion of said anchor in transverse relationship to the longitudinal axis of the latter;

filling at least a portion of the anchor cavity with an initially flowable material which after said filling will harden and set, said step of filling said cavity occurring subsequent to said step of securing said plug in said anchor cavity;

placing a first end portion of an elongated tower leg connector member into the material-filled cavity, prior to hardening and setting of said material;

positioning said member in said cavity as necessary to properly align the member for later securement to said tower leg, thereby compensating for installation error of said anchor;

maintaining said member in said proper alignment until said material has sufficiently hardened and set to maintain said member in said proper alignment; and connecting a second end portion of said member remote from said first end portion to said tower leg.

2. A method as set forth in claim 1, the step of securing said plug including the steps of:

mixing an expandable chemical agent and an expansion including catalyst in a flexible, expandable container;

placing said container in said anchor cavity;

maintaining said container in said cavity until said agent-catalyst mixture has expanded sufficiently to be self-supporting in said cavity.

3. A method of providing support for an elongated tower leg, comprising the steps of:

providing an elongated screw anchor having a lower, elongated shaft portion and an outwardly extending, helix-defining, load-bearig element affixed in transverse relationship to the longitudinal axis of said shaft portion;

rotating the shaft portion while said load-bearing element is in contact with the earth to at least partially imbed said screw anchor in an upright position in the ground;

interrupting the rotation of said shaft portion of said anchor to position an upper portion of said anchor having cavity defining structure at any selected one of a number of different elevations relative to the level of the ground;

filling at least a portion of the anchor cavity with an initially flowable material which after said filling will harden and set, said step of filling said anchor cavity including the steps of filling a portion of said cavity with a sand filler and placing epoxy resin over said sand filler in a sufficient quantity to saturate said sand filler;

placing a first end portion of an elongated tower leg connector member into the material-filled cavity, prior to hardening and setting of said material;

positioning said member in said cavity as necessary to properly align the member for later securement to said tower leg, thereby compensating for installation error of said anchor;

maintaining said member in said proper alignment until said material has sufficiently hardened and set to maintain said member in said proper alignment; and connecting a second end portion of said member remote from said first end portion to said tower leg.

* * * * *